US011180289B2

(12) United States Patent
Kobayashi

(10) Patent No.: US 11,180,289 B2
(45) Date of Patent: Nov. 23, 2021

(54) LID FOR CONTAINER

(71) Applicant: Asahi Kasei Home Products Corporation, Tokyo (JP)

(72) Inventor: Hisaaki Kobayashi, Tokyo (JP)

(73) Assignee: ASAHI KASEI HOME PRODUCTS CORPORATION, Tokyo (JP)

( * ) Notice: Subject to any disclaimer, the term of this patent is extended or adjusted under 35 U.S.C. 154(b) by 73 days.

(21) Appl. No.: 16/565,850

(22) Filed: Sep. 10, 2019

(65) Prior Publication Data

US 2020/0102125 A1 Apr. 2, 2020

(30) Foreign Application Priority Data

Sep. 12, 2018 (JP) ..... JP2018-170756

(51) Int. Cl.
*B65D 43/02* (2006.01)

(52) U.S. Cl.
CPC ..... *B65D 43/0218* (2013.01); *B65D 2543/00194* (2013.01); *B65D 2543/00296* (2013.01); *B65D 2543/00555* (2013.01); *B65D 2543/00842* (2013.01)

(58) Field of Classification Search
CPC .. B65D 1/26; B65D 21/0233; B65D 43/0208; B65D 2543/00101; B65D 2543/00537; B65D 2543/00555; B65D 2543/00685; B65D 2543/00509; B65D 2543/00842; B65D 2543/0062; B65D 2543/00296; B65D 2543/00731; B65D 2543/00027; B65D 2543/00796; B65D 2543/0218; B65D 2543/00194; B65D 2543/0029
USPC ..... 220/4.21, 4.24, 4.25, 526, 532–533, 220/555–556, 780–782, 793–794; 206/508
See application file for complete search history.

(56) References Cited

U.S. PATENT DOCUMENTS 4,235,338 A * 11/1980 Dugan ..... B65D 1/22 206/443
4,564,116 A * 1/1986 Prohaska ..... B65D 41/44 215/256
4,809,868 A * 3/1989 Pomroy ..... B65D 43/0218 220/260
5,377,860 A * 1/1995 Littlejohn ..... B65D 21/0219 220/4.21

(Continued)

FOREIGN PATENT DOCUMENTS

JP 10-264951 A 10/1998
JP 2002-518265 A 6/2002
KR 10-0396418 9/2003

*Primary Examiner* — J. Gregory Pickett
*Assistant Examiner* — Brijesh V. Patel
(74) *Attorney, Agent, or Firm* — Greenblum & Bernstein, P.L.C.

(57) ABSTRACT

Provided is a resin container lid in which a trouble such as a crack is prevented while maintaining easiness in opening even under a refrigerating or freezing environment, the resin container lid configured to be fitted to and detached from a resin container, the resin container lid including a flange part configured to be fitted to a container, the flange part being formed at a peripheral edge of the resin container lid, and an opening tab for detachment from the container, the opening tab projecting into an outer periphery from the flange part, with the tab having a flexural strength of 50 to 80 N under an environment of −30° C.

6 Claims, 3 Drawing Sheets

(56) References Cited

U.S. PATENT DOCUMENTS

| | | | | | |
|---|---|---|---|---|---|
| 5,624,051 | A * | 4/1997 | Ahern, Jr. | B65D 1/36 | 220/281 |
| 5,984,130 | A * | 11/1999 | Hayes | B65D 1/34 | 206/508 |
| 5,992,679 | A | 11/1999 | Porchia et al. | | |
| 6,032,827 | A * | 3/2000 | Zettle | B65D 43/0212 | 220/788 |
| 6,168,044 | B1 * | 1/2001 | Zettle | B65D 43/0208 | 220/784 |
| 6,170,696 | B1 * | 1/2001 | Tucker | B65D 1/26 | 206/508 |
| 6,789,393 | B2 * | 9/2004 | Dais | B65D 43/021 | 62/112 |
| 7,261,219 | B2 * | 8/2007 | Tucker | B65D 1/26 | 206/508 |
| 9,340,330 | B2 * | 5/2016 | LeBoeuf | B65D 43/0208 | |
| 2005/0194390 | A1 * | 9/2005 | Savicki, Jr. | B65D 43/0208 | 220/781 |
| 2007/0202221 | A1 * | 8/2007 | Hinze | B65D 21/0219 | 426/129 |
| 2008/0073368 | A1 * | 3/2008 | Custer | B65D 51/1627 | 220/793 |
| 2008/0160143 | A1 * | 7/2008 | Edwards | B65D 1/34 | 426/129 |
| 2009/0084796 | A1 * | 4/2009 | Coonce | B65D 43/0208 | 220/508 |

* cited by examiner

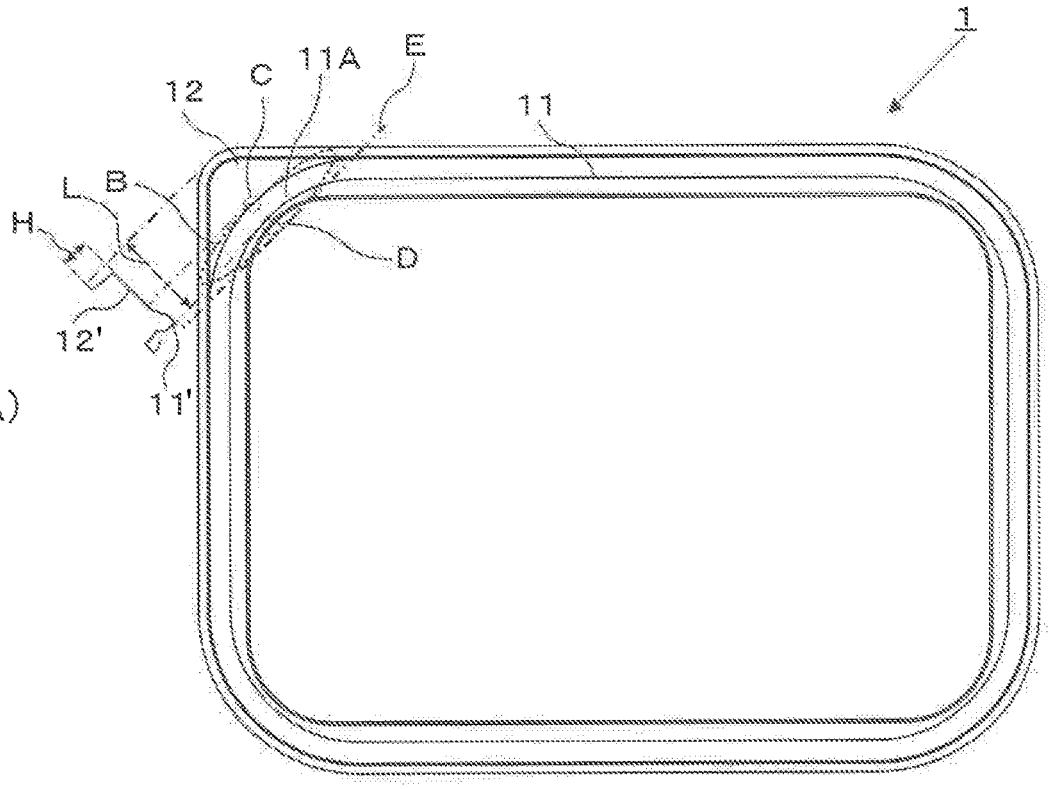
FIG. 1(A)
FIG. 1(B)
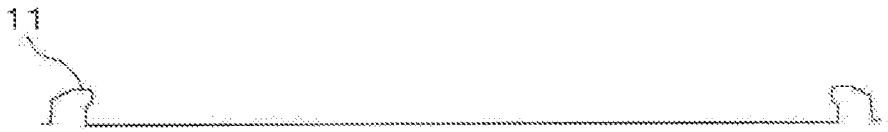

LID FOR CONTAINER

BACKGROUND OF THE INVENTION

Field of the Invention

The present invention relates to a resin container lid capable of being fitted to and detached from a resin container.

Description of the Related Art

Conventionally, a resin container with a lid is known as a container for preserving food. Such a container with a lid has a detachably fitting configuration in which a recessed or projecting flange part is formed at a peripheral edge of each of the container and the lid, and these flange parts with a recessed or projecting shape are fitted to and detached from each other.

Such a container lid is provided with a tab serving as a knob for detaching the lid at an outer periphery of the flange part so as to easily detach the flange parts from each other to open the lid. Various kinds of efforts have been conventionally made on tabs in terms of shapes, sizes, and resin materials in order to facilitate opening of the lid. A technique of providing a reinforcing member for stiffening the tab and allowing the tab to withstand stress applied thereto at the time of opening the lid has been known, for example (see National Publication of International Patent Application No. 2002-518265).

Such a container with a lid is generally assumed to be used such that the container is stored in a refrigerator or freezer after accommodating food and the like, taken out from the refrigerator or freezer in a state of being cooled in the use of the food, and opened to be heated by a microwave oven. Since a container with a lid itself is cooled when the container is taken from a refrigerator or freezer, the resin itself becomes hard, and hardness at the time of opening the lid is different from that at ordinary temperature. In addition, a container especially taken out from a freezer is partly affected by food-originated moisture solidifying at the gap between the container and the lid fitted to each other to cause the lid to tightly adhere to the container, and the container and the lid is more likely to be firmly fitted. As a result, a trouble such as occurrence of a crack between the tab and the flange part in opening the lid may be caused.

One object of the present invention is to provide a resin container lid in which a trouble such as occurrence of a crack is prevented while maintaining easiness in opening under a refrigerating or freezing environment.

SUMMARY OF THE INVENTION

In order to solve the above problem, a deforming situation of a resin lid during detachment has been observed to find that a crack starting from the vicinity of a flange part at the base of a tab of the resin lid (the vicinity of B in FIG. 1(A)) occurs, and the present invention has been completed thereby.

A resin container lid of the present invention is a resin container lid configured to be fitted to and detached from a resin container, the resin container lid including a flange part being formed at a peripheral edge of the resin container lid, the flange part configured to be fitted to a container, and a tab for detachment form the container, the tab projecting into an outer periphery from the flange part, with the tab having a flexural strength of 50 to 80 N under an environment of −30° C.

According to the above aspect, occurrence of a crack at the vicinity of the flange part at the base of the tab of the resin lid (the vicinity of B in FIG. 1(A)) can be suppressed, and easiness in opening the lid can be secured at the same time. That is, the lower the flexural strength of the tab is, the easier the tab elastically deforms, and stress does not concentrate at the vicinity of the flange part at the base of the tab. Therefore, whereas a possibility that a crack occurs within the area is reduced, the tab bends at the time of opening and force enough to detach the flange part is not transmitted. On the other hand, the higher the flexural strength of the tab is, the tougher the tab becomes, and therefore, stress concentrates at the vicinity of the flange part at the base of the tab and a possibility that a crack occurs within the area is increased. In the present aspect, a tab in which excess stress is not allowed to concentrate at the vicinity of the flange part at the base of the tab while keeping elasticity suitable for opening is configured by setting the flexural strength of the tab to 50 to 80 N under an environment of −30° C., which is lower than a temperature under a freezing environment at home.

In another aspect of the present invention, when a vertically upward load of 1 N is applied on the tab with the lid fitted to a container (with the lid being fixed to a container) and stress generated at that time is obtained by linear stress analysis, a ratio between a maximum principal stress generated at a central part of a tab base (C in FIG. 1(A)) and a maximum principal stress generated at a central part of a flange corner at the base of the tab(D in FIG. 1(A)) (maximum principal stress generated at the central part of the flange corner at the base of tab/maximum principal stress generated at the central part of the tab base) is 2.0 to 4.5.

According to this aspect, an effect similar to the effect produced by the flexural strength of the tab specified in the above aspect can be obtained, and a tab having elasticity suitable for opening and not allowing excess stress to concentrate at the vicinity of the flange part at the base of the tab at the time of opening the lid can be configured.

In yet another aspect of the present invention, force for detaching the tab from the container is 10 to 30 N under an environment of −18° C.

According to the above aspect, excess stress is not allowed to concentrate at the vicinity of the flange part at the base of the tab at the time of opening the lid and occurrence of a crack at the vicinity of the flange part can be prevented under an environment of −18° C. assuming a freezing environment at home.

According to the present invention, a resin container lid in which occurrence of a trouble such as a crack is prevented while maintaining easiness in opening even under a refrigerating or freezing environment can be provided.

BRIEF DESCRIPTION OF THE DRAWINGS

FIGS. 1(A) and 1(B) are a plan view and a cross-sectional view illustrating an overall configuration of a resin container lid of the present embodiment;

DETAILED DESCRIPTION OF THE PREFERRED EMBODIMENTS

Figure 2:
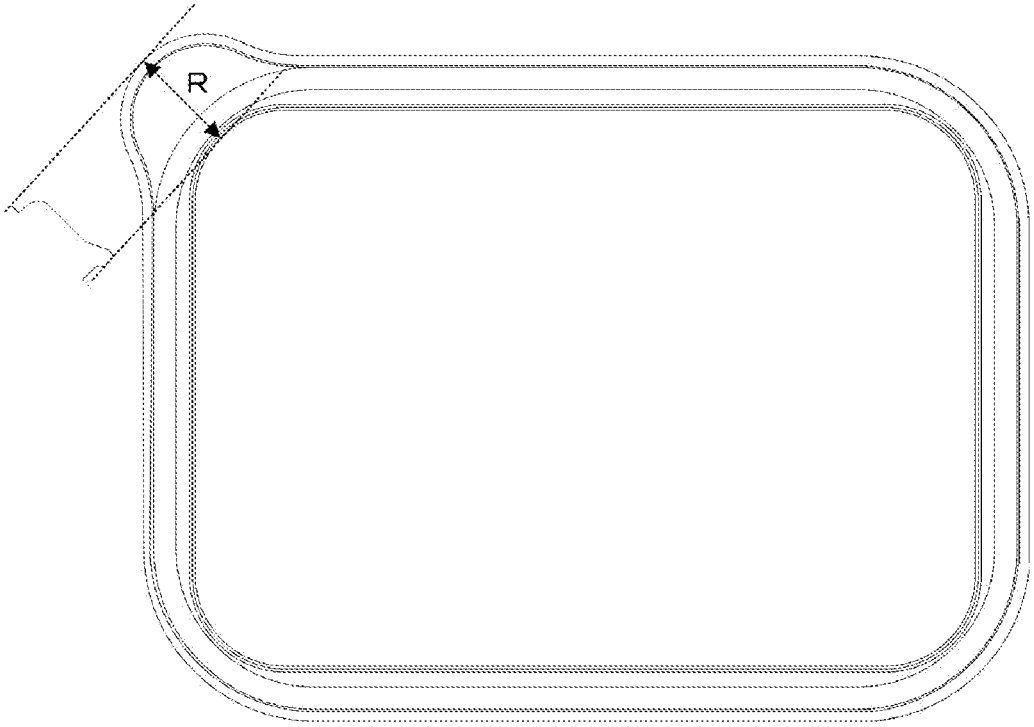
FIG. 2 is a diagram illustrating an example in which an area of a tab of the resin container lid of the present embodiment is changed.

Hereinafter, the present invention will be described with reference to drawings based on a preferable embodiment (hereinafter, referred to as "the present embodiment"). The same sign is assigned to the same or equivalent component, member, or process shown in each figure, and overlapped description is appropriately omitted. In addition, the present embodiment is an example and does not limit the invention. All features and a combination thereof described in the present embodiment are not necessarily essential features of the invention.

A configuration of a resin container lid 1 of the present embodiment will be described using FIGS. 1(A) and 1(B). FIGS. 1(A) and 1(B) are a plan view and a cross-sectional view illustrating an overall configuration of the resin container lid 1.

An overall shape of the resin container lid 1 is a laterally-long rectangular shape, and the resin container lid 1 is attachable to and detachable from a resin container and includes a flange part 11 and a tab 12 projecting into an outer periphery from the flange part 11. Note that while the resin container lid 1 in the present embodiment is presented by a laterally-long rectangular shape, the shape of the resin container lid 1 is not limited thereto and may be a square shape or may be formed by a circler shape or a polygonal shape.

The resin container lid 1 is molded from a thermoplastic resin, and a resin mainly containing a propylene-based resin is preferably used. The propylene-based resin is a polymer in which the content of a monomer unit derived from propylene is 51% by weight or more and preferably 80% by weight or more. The propylene-based resin may contain a monomer unit derived from an olefin other than propylene, and examples of the olefin other than propylene include ethylene, 1-butene, 1-pentene, 1-hexene, 4-methyl-1-pentene, 1-octene, and 1-decene. Examples of the propylene-based resin include a propylene homopolymer, an ethylene-propylene copolymer, a propylene-1-butene copolymer, propylene-1-hexene copolymer, a propylene-1-octene copolymer, a propylene-ethylene-1-butene copolymer, and an ethylene-propylene-1-hexene copolymer, and one or two or more kinds of these homopolymer, copolymers, and the like are used. Desirably, the propylene-based resin is molded with an elastomer added thereto as needed so as to have appropriate flexibility. As a preferable elastomer, ethylene-α-olefin-based copolymer rubber or styrene-butadiene-based copolymer rubber is used. Materials of the container lid 1 are not limited thereto, and can be arbitrarily selected from known thermoplastic resins such as a polyamide, a polyacrylate, a polyarylate, a polycarbonate, a polyester, a polyether imide, a polyether ketone, a polyolefin, a polyphenylene, and polyvinyl chloride. Various additives such as a slipping agent, a nucleating agent, an antistatic agent, a heat-resistant stabilizer, an antioxidant, a release agent, and a pigment can be added.

The flange part 11 is formed into a shape recessed or projecting from a bottom side at a peripheral edge, and this recessed or projecting part are fitted to and detached from a projecting or recessed shape of a flange part at the side of a resin container to allow the resin container lid 1 to attach to and detach from the resin container.

The tab 12 is formed at one round-chamfered corner part 11A of the flange part 11. The tab 12 projects into an outer periphery from the flange part 11 and serves as a knob for a user when the resin container lid 1 is opened by detaching the resin container lid 1 from a container. The tab 12 may be formed at at least one round-chamfered corner part 11A of the flange part 11 and may be formed also at another corner part to form plural tabs.

In the present embodiment, the tab 12 has a shape satisfying the following conditions. That is, the tab 12 has a shape in which the flexural strength of the tab 12 is 50 to 80 N under an environment of −30° C. More desirably, the tab 12 has a shape in which the flexural strength is 60 to 80 N. Note that a value of flexural strength of the tab 12 is measured by vertically pushing the tab 12 from the downward of the tab 12 of the resin container lid 1 by a jig to deform the tab 12 from the round-chamfered corner part 11A of the flange part 11 in order to reproduce an opening manner with the tab serving as a fulcrum under a freezing environment. At that time, the dashed-two dotted line E shown in FIG. 1(A) is set as a boundary, and a part opposite to the tab 12 across this dashed-two dotted line E is sandwiched between two metal plates and fixed so that the tab 12 deforms from the round-chamfered corner part 11A of the flange part 11.

Here, the vicinity of the flange part at the base of the tab where a crack may occur is an area shown as the area B outlined by a dashed line in FIG. 1(A). When the tab 12 is lifted as a knob at the time of detaching the resin container lid 1 from a container, stress concentrates at the vicinity of the flange part at the base of the tab (the vicinity of B in FIG. 1(A)), and a crack starting therefrom occurs. The tab 12 of the present invention is designed in a shape in which such a crack does not occur.

As described above, a shape of the tab is set so that the flexural strength of the tab 12 is 50 to 80 N under an environment of −30° C. More specifically, a height H (see FIG. 1(A)) of the tab or a radius R (see FIG. 2) of the tab is set. Consequently, occurrence of a crack at the vicinity of the flange part at the base of the tab (the vicinity of B in FIG. 1(A)) can be suppressed, and easiness in opening the lid can be secured at the same time. Reference characters 11' and 12' in FIG. 1(A) represent schematic projections of the flange part 11 and the tab 12, respectively, at an underside of the tab 12. The height H extends downward with respect to the plan view in FIG. 1(A).

That is, the lower the flexural strength of the tab 12 is, the easier the tab 12 elastically deforms, and stress does not concentrate at the vicinity of the flange part at the base of the tab (the vicinity of B in FIG. 1(A)). Therefore, whereas a possibility that a crack occurs within the area B is reduced, the tab 12 bends at the time of opening and force enough to detach the flange part 11 is not transmitted. On the other hand, the higher the flexural strength of the tab 12 is, the tougher the tab 12 becomes, and therefore, stress concentrates at the vicinity of the flange part of the base of the tab (the vicinity of B in FIG. 1(A)) and a possibility that a crack occurs within the area B is increased.

In the present embodiment, the flexural strength of the tab 12 under an environment of −30° C., which is lower than a temperature under a freezing environment at home, is set to 50 to 80 N, and consequently, excess stress is not allowed to concentrate at the vicinity of the flange part at the base of the tab (the vicinity of B in FIG. 1(A)) while keeping elasticity suitable for opening.

In addition, when a shape of the tab 12 is formed so that the flexural strength of the tab 12 is 60 to 80 N, enhanced easiness in opening can be kept while preventing occurrence of a crack.

In addition, when a vertically upward load of 1 N is applied on the tab 12 from the downward with the resin container lid 1 fitted and fixed to a container and stress generated at that time is obtained by linear stress analysis, a stress ratio between a maximum principal stress generated at the central part of the tab base (C) (see FIG. 1(A)) and a maximum principal stress generated at a central part of a flange corner at the base of the tab(D) (see FIG. 1(A)) (maximum principal stress generated at central part of flange corner at base of tab/maximum principal stress generated at the central part of the tab base) is 2.0 to 4.5. This stress ratio is more desirably 3.5 to 4.5.

A tab in which excess stress is not allowed to concentrate at the vicinity of the flange part at the base of the tab (the vicinity of B in FIG. 1(A)) while keeping elasticity suitable for opening can be configured by specifying the stress ratio between the maximum principal stress generated at the central part of the tab base (C) and the maximum principal stress generated at the central part of the flange corner at the base of the tab(D) (maximum principal stress generated at central part of flange corner at base of tab/maximum principal stress generated at the central part of the tab base) as with the flexural strength of the tab.

In addition, force for detaching the tab 12 from a container is 10 to 30 N under an environment of −18° C. assuming a freezing environment at home. This force is more desirably 10 to 15 N.

By virtue of setting the shape of the tab 12 so that force for detaching the tab from a container is 10 to 30 N under an environment of −18° C., occurrence of a crack at the vicinity of the flange part (the vicinity of B in FIG. 1(A)) can be also suppressed, and easiness in opening the lid can be maintained at the same time.

Figure 3:
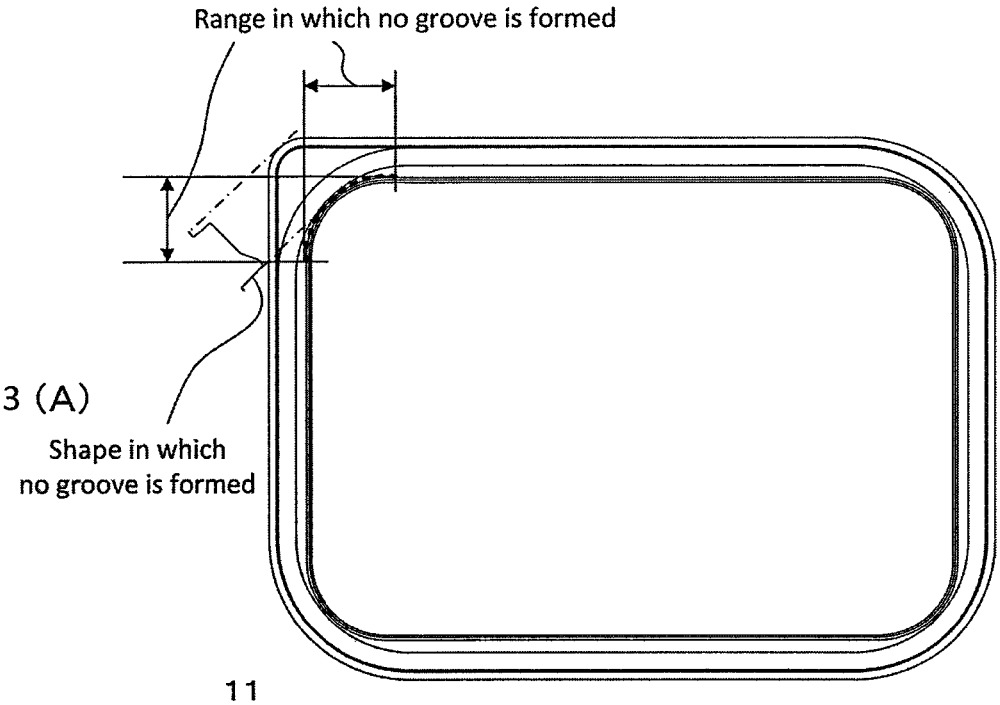
FIGS. 3(A) and 3(B) are diagrams illustrating an example in which a shape of a flange part at the vicinity of the tab of the resin container lid of the present embodiment is changed.
Figure 3:
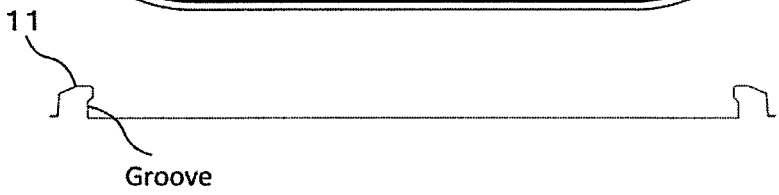

More preferably, a range in which no groove is formed (grooveless part) is provided at an inner peripheral side of the flange part 11 at the vicinity of the tab (see the range illustrated by the thick dashed line in FIG. 3(A)) so that force for detaching the tab from a container is 10 to 15 N. Consequently, opening of the lid can be made still easier. Note that when force for detaching the tab from a container is less than 10 N, such a trbouble that the lid cannot tightly close occurs.

As described above, excess stress is not allowed to concentrate at the vicinity of the flange part at the base of the tab (the vicinity of B in FIG. 1(A)) and occurrence of a crack can be prevented within the area B by setting force for detaching the tab 12 from a container under an environment of −18° C. assuming a freezing environment at home to 10 to 30 N.

EXAMPLE 1

The present invention will be described in more detail by the following examples and comparative examples. However, the present invention is not limited to the following examples at all.

As examples and comparative examples, shapes of the tab in the resin container lid 1 of the present embodiment and other shapes were evaluated in terms of the following five evaluations: (1) measurement of flexural strength of the tab,(2) analysis of maximum principal stress and stress ratio, (3) confirmation of crack occurrence rate at vicinity of a flange part at a base of the tab (vicinity of B in FIG. 1(A)) and subjective evaluation on crack occurrence, (4) evaluation on opening force of the lid, and (5) subjective evaluation on easiness in opening the lid.

The above evaluations (1) to (5) were conducted on, as examples of shapes of the tab of the resin container lid, examples in which a height H (see FIG. 1(A)) of the tab was changed with an area of the plane surface of the tab kept constant (Nos. 1 to 13 in Table 1 and Table 2), examples in which an area of the plane surface of the tab was changed by changing a radius R of the round-chamfered part (see FIG. 2) with a height H of the tab kept constant (Nos. 14 to 16 in Table 3), and examples in which a range with no groove formed in the inner periphery of the flange part (see FIG. 3) was changed Specifically, as examples in which a height of the tab H was changed, the height was set to 2.0 mm (Example 1), 2.6 mm (Example 2), 3.6 mm (Example 3), and 3.8 mm (Examples 4 and 5) using a resin sheet of propylene-based resin-A (PP resin-A) (tensile modulus: 750 MPa) with a sheet thickness of 0.65 mm. Note that in Example 5, a resin sheet of PP resin-A to which an elastomer (ethylene-1-butene copolymer) was added in an amount of 10 wt % (tensile modulus: 710 MPa) with a sheet thickness of 0.65 mm was used. In addition, as comparative examples in which a height of the tab H was changed, the height of the tab H was set to 0 mm (Comparative Example 1) and 7.0 mm (Comparative Example 2) using a resin sheet of PP resin-A (tensile modulus: 750 MPa) with a sheet thickness of 0.65 mm. Note that the length of the tab L in these Examples and Comparative Examples was set to 15 mm.

In addition, as examples in which a height of the tab H was changed, the height was set to 3.4 mm (Example 6), 3.8 mm (Example 7), 4.0 mm (Example 8), and 4.3 mm (Example 9) using a resin sheet of propylene-based resin-B (PP resin-B) (tensile modulus: 680 MPa) with a sheet thickness of 0.65 mm as a resin sheet having a different modulus of elasticity. As comparative examples thereof, the height of the tab H was set to 0 mm (Comparative Example 3) and 7.0 mm (Comparative Example 4). Note that the length of the tab L in these Examples and Comparative Examples was set to 15 mm.

Next, as examples in which an area of the plane surface of the tab was changed, the radius R of the tab was set to 15 mm (Example 10) and 17 mm (Example 11) using a resin sheet of PP resin-A (tensile modulus: 750 MPa) with a sheet thickness of 0.65 mm. In addition, the radius R of the tab was set to 20 mm (Comparative Example 5) as a comparative example. Note that the height of the tab H in these Examples and Comparative Example was set to 4.8 mm.

Further, as examples in which a range with no groove formed in the inner peripheral side of the flange part 11 at the vicinity of the tab was changed, an example with a groove formed (Example 12) and examples with their grooveless ranges set to 5 mm (Example 13), 10 mm (Example 14), 15 mm (Example 15), and 20 mm (Example 16) were employed using a resin sheet of PP resin-A (tensile modulus: 750 MPa) with a sheet thickness of 0.65 mm. Note that the height of the tab H and the length of the tab L in these Examples were set to 3.4 mm and 15 mm, respectively.

Hereinafter, evaluation methods for the tensile moduli of the resin sheets and the evaluations (1) to (5) described above will be described in detail. The tensile moduli of the resin sheets were evaluated according to JIS K7161. That is, a strip-shaped specimen which enabled measurement with a distance between grippers of 100 mm and a width of 10 mm was cut out, the specimen was attached to grippers of a tensile and compression testing machine (AUTOGRAPH manufactured by SHIMADZU CORPORATION), and measurement was conducted at a tensile speed of 1 mm/minute under an environment at a room temperature of 23° C. and a relative humidity RH of 50%. Number of evaluations was five points for each of the longitudinal direction and the width direction of the resin sheet, and the average value of all values was calculated. Note that a value of a tensile modulus was calculated by the following calculus equation.

$$E=(\sigma 2-\sigma 1)/(\epsilon 2-\epsilon 1)$$

In the formula, E: tensile modulus (MPa);

$\epsilon 1$: (strain 1): 0.0005 (increased amount of specimen of 0.05 mm/distance between grippers of 100 mm);

$\epsilon 2$: (strain 2): 0.0025 (increased amount of specimen of 0.25 mm/distance between grippers of 100 mm);

$\sigma 1$: stress in strain $\epsilon 1$ (MPa); and $\sigma 2$: stress in strain $\epsilon 2$ (MPa).

(1) In order to reproduce an opening manner with the tab of a frozen and stored product serving as a fulcrum, the flexural strength of the tab was evaluated under a temperature of −30° C. as follows. The dashed-two dotted line E shown in FIG. 1(A) was set as a boundary, a part opposite to the tab 12 across this dashed-two dotted line E was sandwiched between two metal plates and fixed so that the tab 12 deformed from the round-chamfered corner part 11A of the flange part 11, the tab 12 was attached to a tensile and compression testing machine (AUTOGRAPH manufactured by SHIMADZU CORPORATION) and pushed in the vertical direction from the downward of the tab 12 at a speed of 1000 mm/minute by a pushing rod having a tip, which had a diameter of 15 mm and had been processed to have a spherical shape, and the maximum value at that time was measured. Number of evaluations was ten, and the average value of all values was calculated.

(2) Maximum principal stress and stress ratios were analyzed by computer aided engineering (CAE) analysis which is simulation by a computer. Specifically, linear stress analysis was conducted with Abaqus used as software. The maximum principal stress generated at the central part of the tab base (C) (see FIG. 1(A)), the maximum principal stress generated at the central part of flange corner at the base of the tab(D) (see FIG. 1(A)), and the stress ratio therebetween (maximum principal stress generated at central part of flange corner at base of tab/maximum principal stress generated at the central part of the tab base) were obtained with the proviso that the container lid was fitted and fixed to a container, a vertical load of 1 N was applied from the downward of the tab, material was polypropylene (Young's modulus: 896 MPa, Poisson's ratio: 0.410), and the thickness was 0.65 mm.

(3) The crack occurrence rate at the vicinity of the flange part at the base of the tab (the vicinity of B in FIG. 1(A)) was confirmed as follows. Water was poured into a container which was then covered with the lid and stored in a freezer (environment of −18° C.) for one day, and the presence or absence of a crack on opening the container lid was confirmed 0.5 minutes after taking the container out from the freezer (sample size n=10). As the opening manner at this time, a manner in which a tester pinched only the tab and lifted the tab to open was employed. Criteria for crack evaluation are based on how many times a crack occurred at the vicinity of the flange part at the base of the tab (the vicinity of B in FIG. 1(A)) out of ten times of observation as follows.

O: zero to one time

Δ: two to three times

X: four times or more (4) In evaluation on opening force, water was poured into a container which was then covered with the lid and stored in a freezer (environment of −18° C.) for one day, the tab was lifted by a force gauge under an environment of 25° C. 0.5 minutes after taking the container out from the freezer, and the maximum value of force required to detach the lid from the container was measured. Number of evaluations was ten, and the average value of all values was calculated. Easiness in opening the lid was determined based on how many times the lid could not be opened because of deformation of the base of the tab out of ten times of observation as follows.

◎: zero times

O: one time

Δ: two to three times

X: four times or more

With reference to the above evaluation results, results of examples in which the height of the tab H was changed are shown in Table 1 and Table 2, results of examples in which the area of the tab was changed are shown in Table 3, and results of examples in which the shape of the flange part at the vicinity of the tab was changed are shown in Table 4.

TABLE 1

| [Change of height of tab-1] | No. Example/ Comparative Example | 1 Comparative Example 1 | 2 Example 1 | 3 Example 2 | 4 Example 3 | 5 Example 4 | 6 Example 5 | 7 Comparative Example 2 |
|---|---|---|---|---|---|---|---|---|
| | Propylene-based resin | PP resin-A | | | | | | |
| | Height of tab (mm) | 0.0 | 2.0 | 2.6 | 3.6 | 3.8 | 3.8 | 7.0 |
| | Length of tab (mm) | 15.0 | 15.0 | 15.0 | 15.0 | 15.0 | 15.0 | 15.0 |
| | Addition amount of elastomer (wt %) | 0 | 0 | 0 | 0 | 0 | 10 | 0 |
| Evaluation items | Conditions | | | | | | | |
| (1) Flexural strength (N) | −30° C. | 34 | 51 | 52 | 72 | 74 | 66 | 94 |
| (2) Maximum principal stress | D | 1.85 | 1.88 | 1.88 | 1.89 | 1.89 | 1.89 | 1.93 |
| (MPa) | C | 0.97 | 0.90 | 0.68 | 0.45 | 0.44 | 0.44 | 0.33 |
| Stress ratio | D/C | 1.9 | 2.1 | 2.8 | 4.2 | 4.3 | 4.3 | 5.8 |
| (3) Crack occurrence rate (%) | | 0 | 10 | 0 | 0 | 10 | 0 | 80 |
| Crack evaluation on tab | | ○ | ○ | ○ | ○ | ○ | ○ | X |
| (4) Opening force (N) | −18° C. | 29 | 17 | 26 | 23 | 25 | 24 | 24 |
| (5) Easiness in opening lid | | X | Δ | Δ | ○ | ○ | ○ | ○ |

* The composition of the elastomer is ethylene-1-butene copolymer.

* C represents the central part of the tab base, and D represents the central part of the flange corner at the base of the tab.

TABLE 2

| [Change of height of tab-2] | No. Example/ Comparative Example | 8 Comparative Example 3 | 9 Example 6 | 10 Example 7 | 11 Example 8 | 12 Example 9 | 13 Comparative Example 4 |
|---|---|---|---|---|---|---|---|
| | Propylene-based resin | | | PP resin-B | | | |
| | Height of tab (mm) | 0.0 | 3.4 | 3.8 | 4.0 | 4.3 | 7.0 |
| | Length of tab (mm) | 15.0 | 15.0 | 15.0 | 15.0 | 15.0 | 15.0 |
| Evaluation items | Conditions | | | | | | |
| (1) Flexural strength (N) | −30° C. | 28 | 50 | 53 | 56 | 60 | 85 |
| (2) Maximum principal stress | D | 1.85 | 1.89 | 1.89 | 1.89 | 1.90 | 1.93 |
| (MPa) | C | 0.97 | 0.50 | 0.44 | 0.43 | 0.42 | 0.33 |
| Stress ratio | D/C | 1.9 | 3.8 | 4.3 | 4.4 | 4.5 | 5.8 |
| (3) Crack occurrence rate (%) | | 0 | 0 | 0 | 0 | 0 | 60 |
| Crack evaluation on tab | | ○ | ○ | ○ | ○ | ○ | X |
| (4) Opening force (N) | −18° C. | 25 | 23 | 25 | 14 | 17 | 20 |
| (5) Easiness in opening lid | | X | Δ | Δ | ○ | ○ | ○ |

* C represents the central part of the tab base, and D represents the central part of the flange corner at the base of the tab.

20

TABLE 3

| [Change of area of tab] | No. Example/Comparative Example | 14 Example 10 | 15 Example 11 | 16 Comparative Example 5 |
|---|---|---|---|---|
| | Propylene-based resin | | PP resin-A | |
| | Height of tab (mm) | 4.8 | 4.8 | 4.8 |
| | Length of tab (mm) | 15.0 | 17.0 | 20.0 |
| Evaluation items | Conditions | | | |
| (1) Flexural strength (N) | −30° C. | 74 | 55 | 48 |
| (2) Maximum principal | D | 2.00 | 2.09 | 2.17 |
| stress (MPa) | C | 0.53 | 0.82 | 1.12 |
| Stress ratio | D/C | 3.8 | 2.5 | 1.9 |
| (3) Crack occurrence rate (%) | | 0 | 10 | 30 |
| Crack evaluation on tab | | ○ | ○ | Δ |
| (4) Opening force (N) | −18° C. | 30 | 40 | 26 |
| (5) Easiness in opening lid | | ○ | Δ | Δ |

* C represents the central part of the tab base, and D represents the central part of the flange corner at the base of the tab.

TABLE 4

| [Change of range with no groove formed] | No. Example/ Comparative Example | 17 Example 12 | 18 Example 13 | 19 Example 14 | 20 Example 15 | 21 Example 16 |
|---|---|---|---|---|---|---|
| | Propylene-based resin | | | PP resin-A | | |
| | Height of tab (mm) | 3.4 | 3.4 | 3.4 | 3.4 | 3.4 |
| | Length of tab (mm) | 15.0 | 15.0 | 15.0 | 15.0 | 15.0 |
| | Range with no groove formed (mm) | None | 5.0 | 10.0 | 15.0 | 20.0 |
| Evaluation items | Conditions | | | | | |
| (1) Flexural strength (N) | −30° C. | 67 | 67 | 67 | 67 | 67 |
| (2) Maximum principal stress | D | 1.89 | 1.89 | 1.89 | 1.89 | 1.89 |
| (MPa) | C | 0.50 | 0.50 | 0.50 | 0.50 | 0.50 |
| Stress ratio | D/C | 3.8 | 3.8 | 3.8 | 3.8 | 3.8 |
| (3) Crack occurrence rate (%) | | 0 | 0 | 0 | 0 | 0 |
| Crack evaluation on tab | | ○ | ○ | ○ | ○ | ○ |
| (4) Opening force (N) | −18° C. | 30 | 27 | 22 | 14 | 10 |
| (5) Easiness in opening lid | | ○ | ○ | ○ | ◎ | ◎ |

* C represents the central part of the tab base, and D represents the central part of the flange corner at the base of the tab.

According to Table 1 to Table 4, it has been found that evaluation on crack occurrence is rated as "O" in each of Examples 1 to 16 in which the height of the tab H, the area of the tab, or the range with no groove formed was set so as to provide a flexural strength of the tab 12 of 50 to 80 N under the environment of −30° C. In addition, it has been found that when stress was obtained by linear stress analysis in which a vertical load of 1 N was applied on the tab 12 from the downward of the tab, the ratio between the stress at the central part of the tab base (C) and the stress at the central part of the flange corner at the base of the tab(D) (maximum principal stress generated at the central part of the flange corner at base of tab/maximum principal stress generated at the central part of the tab base) is within 2.0 to 4.5 in each of Examples 1 to 16. Further, functional evaluation on easiness in opening the lid is also rated as "◎," "O," or "Δ" and a certain level of easiness in opening has been found to be also secured in each of these Examples 1 to 16.

Further, evaluation on crack occurrence is similarly rated as "O" for the tab 12 in each of Examples 1 to 10 in which force (opening force) for detachment from the container is within 10 to 30 N under the environment of −18° C. In addition, functional evaluation on easiness in opening the lid is also rated as "O" or "Δ," and a certain level of easiness in opening has been found to be also secured in each of these Examples 1 to 10.

Further, it has been found that functional evaluation on easiness in opening the lid is rated as "◎" in each of Examples 15 and 16 in which the height of the tab H was set so as to provide a flexural strength of the tab 12 of 60 to 80 N under the environment of −30° C. and the range with no groove formed (grooveless part) in the inner peripheral side of the flange part 11 at the vicinity of the tab was provided so that force for detachment from the container is 10 to 15 N, and easiness in opening has been found to be further enhanced.

What is claimed is:

1. A resin container lid configured to be fitted to and detached from a resin container, the resin container lid comprising:

a flange part being formed at a peripheral edge of the resin container lid, the flange part configured to be fitted to the resin container; and an opening tab for detaching the resin container lid from the resin container, the opening tab being formed on the flange part and projecting from the flange part to an outer periphery of the resin container lid, wherein the opening tab has a flexural strength of 50 to 80 N under an environment of −30° C.

2. The resin container lid according to claim 1, wherein the opening tab includes a tab base and is configured such that a stress generated by a vertically upward load of 1 N being applied to the opening tab with the resin container lid fitted on the resin container has a stress ratio (D/C) of 2.0 to 4.5 as obtained by a linear stress analysis, the stress ratio (D/C) being defined between a maximum principal stress (C) generated at a central part of the tab base and a maximum principal stress (D) generated at a central part of a flange corner at the tab base.

3. The resin container lid according to claim 2, wherein a force for detaching the opening tab from the resin container is 10 to 30 N under an environment of −18° C.

4. The resin container lid according to claim 1, wherein a force for detaching the opening tab from the resin container is 10 to 30 N under an environment of −18° C.

5. The resin container lid according to claim 1, wherein the opening tab has a height (H) and a length (L), a height-length ratio defined between the height (H) and the length (L) of the opening tab is 2.0/15.0 (H/L) to 3.8/15 (H/L), and the resin comprises a propylene-based resin-A (PP resin-A).

6. The resin container lid according to claim 1, wherein the opening tab has a height (H) and a length (L), a height-length ratio defined between the height (H) and the length (L) of the opening tab is 3.4/15.0 (H/L) to 4.3/15 (H/L), and the resin comprises a propylene-based resin-B (PP resin-B).

* * * * *